US007443273B2

(12) United States Patent
Findeisen

(10) Patent No.: US 7,443,273 B2
(45) Date of Patent: Oct. 28, 2008

(54) ARRANGEMENT FOR COOLING OF COMPONENTS OF WIND ENERGY INSTALLATIONS

(75) Inventor: Jörg Findeisen, Dresden (DE)

(73) Assignee: Siemens Aktiengesellschaft, Munich (DE)

( * ) Notice: Subject to any disclaimer, the term of this patent is extended or adjusted under 35 U.S.C. 154(b) by 8 days.

(21) Appl. No.: 11/629,936

(22) PCT Filed: May 13, 2005

(86) PCT No.: PCT/DE2005/000919

§ 371 (c)(1),
(2), (4) Date: Dec. 18, 2006

(87) PCT Pub. No.: WO2005/124799

PCT Pub. Date: Dec. 29, 2005

(65) Prior Publication Data

US 2007/0229205 A1 Oct. 4, 2007

(30) Foreign Application Priority Data

Jun. 18, 2004 (DE) ..... 10 2004 030 522

(51) Int. Cl.
*H01F 27/02* (2006.01)
*H01F 27/08* (2006.01)
*H01F 27/10* (2006.01)

(52) U.S. Cl. ..... 336/60; 336/57; 336/59

(58) Field of Classification Search ..... 336/55–60
See application file for complete search history.

(56) References Cited

U.S. PATENT DOCUMENTS

| | | | | |
|---|---|---|---|---|
| 4,549,603 | A * | 10/1985 | Shirai et al. | 165/104.33 |
| 5,329,101 | A * | 7/1994 | Ellis | 219/632 |
| 6,201,225 | B1 * | 3/2001 | Lee | 219/757 |
| 6,909,349 | B1 * | 6/2005 | Longardner et al. | 336/60 |

FOREIGN PATENT DOCUMENTS

| | | | |
|---|---|---|---|
| DE | 903 008 | | 2/1954 |
| DE | 34 27 459 | A1 | 2/1986 |
| DE | 199 47 915 | A1 | 4/2001 |
| DE | 299 24 401 | U1 | 2/2003 |
| EP | 0 551 554 | A1 | 7/1993 |
| EP | 1 237 246 | A1 | 9/2002 |
| JP | 09097720 | A * | 4/1997 |
| WO | WO 99/30031 | | 6/1999 |

* cited by examiner

*Primary Examiner*—Anh T Mai
(74) *Attorney, Agent, or Firm*—Laurence A. Greenberg; Werner H. Stemer; Ralph E. Locher

(57) ABSTRACT

The system utilizes the flow of a medium for cooling an installation, especially a transformer. The fact is utilized that the flow of the medium, e.g. wind, automatically increases with increasing load of the transformer. The novel transformer is formed so that its outer shape and the cooling elements are impinged upon by the natural air flow to a maximum degree. For this purpose, the cooling elements across their length are adapted to have a large cross-sectional area for the flowing medium. The depth of the cooling elements is chosen such that the flow resistance is not too high and so as to achieve a turbulent flow of the cooling air. Distance and arrangement of the cooling elements are chosen such that the transformer tank itself is reached by the flowing medium and serves for cooling.

17 Claims, 13 Drawing Sheets

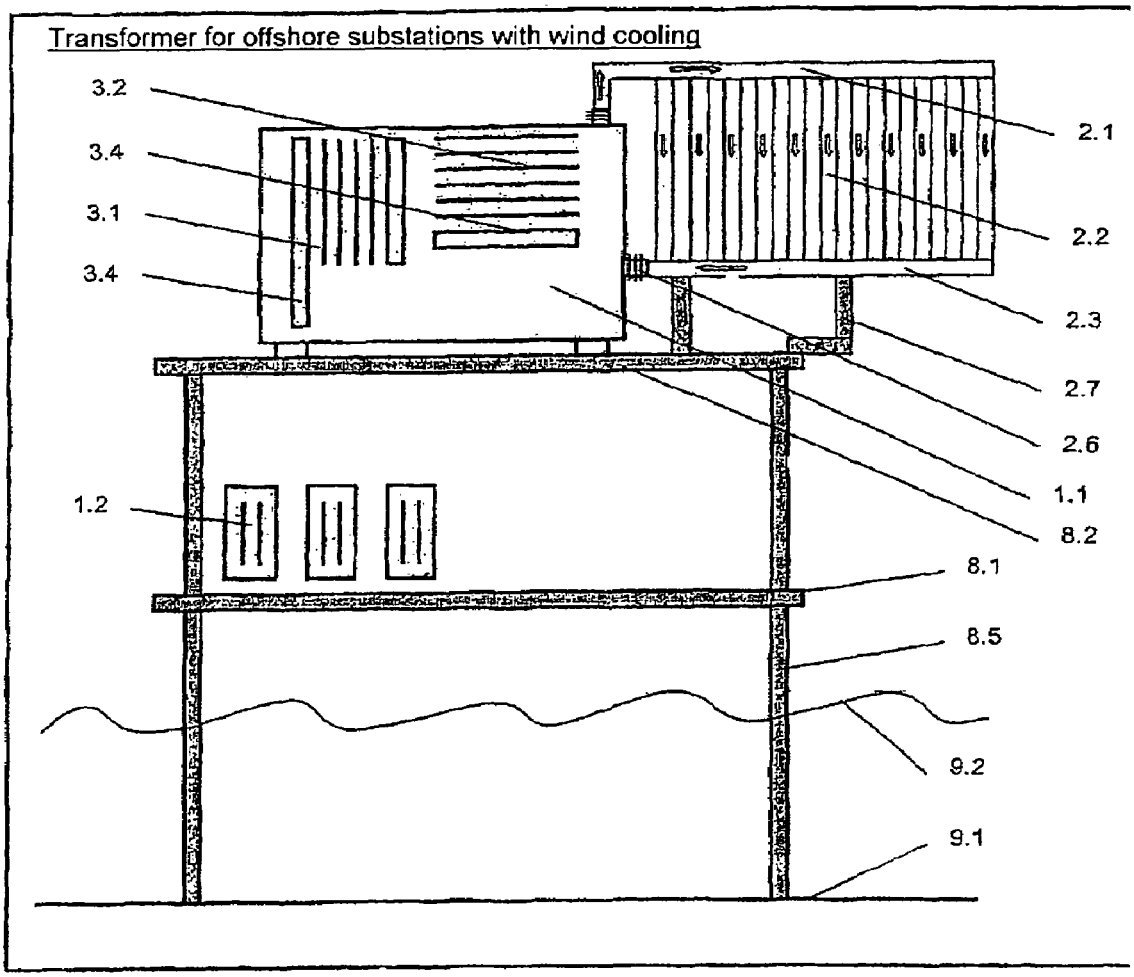

*FI. -12/03*

1.1 - Installation 1 producing heat losses (for example transformer in a wind park)
1.2 - Installation 2 producing heat losses (for example converter)
2.2 - Cooling element
2.7 - Oscillation decoupling (for example compensators)
2.7 - Separate attachment for the cooling installation
3.1 - Cooling surfaces
4.4 - Depressions in the form of additional cooling surfaces
8.2 - Platform of the offshore substation
8.5 - Pier of the offshore substation
9.1 - Seabed
9.2 - Water level

FIG. 2

1 - Transformer platform

2 - Cooling installation

3 - Surface cooler

4 - Cable connections

8 - Offshore 9.1 - Seabed 9.2 - Water level

Specially designed wind-park transformer (cooling by natural air flow)

1 - Transformer (or other installation part to be cooled) in the wind park
2 - Cooling element
5.1 - Air flow guidance device, formed by a specific design of elements and parts of the outer casing of the transformer
5.2 - Air flow guidance device for cooling element 3.5 - Pivoting elements

ARRANGEMENT FOR COOLING OF COMPONENTS OF WIND ENERGY INSTALLATIONS

BACKGROUND OF THE INVENTION

Field of the Invention

The invention relates to an arrangement for cooling of components of wind energy installations.

The prior art is the use of conventional transformers in which the losses to be dissipated are reduced by means of radiators and fans. These are generally fitted alongside one another on the tank wall of the transformer. A large number of radiators are required for this purpose. Fans are fitted to these radiators, for vertical or horizontal air circulation. In the case of wind-park transformers on land, it is also necessary to comply with noise regulations, and this leads to the use of slowly rotating, relative low-noise fans. In order nevertheless to achieve the cooling performance, a greater number of fans are therefore required—with the greater procurement and operating costs associated with them.

A further serious disadvantage is represented by the need to ensure corrosion protection and ingress protection because of the aggressive environmental conditions, and particularly in the off-shore area. The fans generally have an opening for condensed water and, in the case of the environmental conditions over sea, this leads to problems and thus to failures. Furthermore, the fans require large amounts of energy, which must be provided by the installation and thus likewise cause costs.

A switching cabinet with switching devices, motor protection switches and monitoring appliances is required at the transformer, in order to control the fans.

The external wiring between the fan switching cabinet and the fans results in further complexity. The fan control cabinet, and the fans themselves also require inspection and maintenance effort (possibly repair effort), and this is associated with considerable costs, particularly in the case of off-shore installations. Since maintenance work cannot be carried out at any time, because of the weather conditions in the off-shore area, the use of low-maintenance and high-availability components is particularly important.

For the purposes of the present invention, the expression "transformer" is used only by way of example for any electrical and/or mechanical installation.

SUMMARY OF THE INVENTION

The object of the invention is to provide effective and simple cooling for transformers.

The aim of the invention is to avoid the abovementioned disadvantages. Effective and simple dissipation of the thermal energy produced in the transformer can be achieved by use, according to the invention, of the wind which is always present during operation of wind energy installations, and by the design according to the invention of the transformer and its components. This likewise reduces the production costs and operating costs of the transformer. The use of the wind for blowing purposes not only avoids the need for the fan switching cabinet, the wiring and the fans themselves, but also the temperature measurement devices for control and the control mechanism. All that is now required is a temperature measurement device (PT100 adequate), for warning monitoring and disconnection.

The operation of wind energy installations is dependent on the presence of a relatively strong air flow. For transformers in wind parks and for off-shore substations, this results in the particular feature for transformers that a natural air flow is always present when the transformer is on load.

However, the flowing medium may also be a liquid. The installation according to the invention can thus also be used in a flow field under water. According to the present invention, a method is provided in which a flowing medium flows around an energy converter, for example a generator, which, as a result of increased power, develops a greater amount of heat associated with this, with the heat being dissipated effectively on the basis of the physical design of the transformer, and of the cooling elements which are connected to the transformer, with the aid of the medium flowing around it.

According to the invention, this air flow is used to cool the transformer. The invention also makes use of the fact that the air flow automatically increases as the load on the transformer increases. According to the invention, the transformer is designed such that the maximum amount of the natural air flow flows around the external surface of the transformer and the cooling elements. For this purpose, the lengths of the cooling elements are designed such that they form a large cross-sectional area for the medium (wind) flowing around them. Furthermore, the depth of the cooling element is designed such that the resistance to the air flow is not excessive, and the cooling air flows through them in a turbulent manner. According to the invention, the cooling elements are arranged such that they are not in each other's wind shadows. The distance between and arrangement of the cooling elements are designed such that the air flow even reaches the transformer tank itself.

Furthermore, additional air is supplied to the cooling elements by means of suitable flow guidance devices. The outer skin of the transformer is designed such that it itself acts as a flow conductor for the cooling elements and for itself. According to the invention, the transformer is designed in such a way that the connections and accessories are arranged such that they do not impede the flow of cooling air. In one particular embodiment of the invention, additional heat-emitting surfaces are fitted to the outer skin of the transformer, and are expediently placed in areas in which the coolant flow conditions are good. These surfaces may be fitted both horizontally and vertically, or at an angle, depending on the flow conditions.

The shape and arrangement of these surfaces are chosen such that, on the one hand, they result in maximum coverage of air as the cooling medium, and at the same time avoid any disturbance of the blowing of other heat-emitting parts. The mechanically required reinforcements in the tank are arranged such that they do not impede the natural blowing of the heat-emitting parts.

In one particular embodiment, the reinforcements and additional cooling surfaces can be designed in such a way that they act as a flow guidance device. The tank and the cooling elements are designed in such a manner that surfaces which radiate to one another are avoided or reduced, and virtually the entire area of the tank can emit heat by radiation.

Furthermore, the cooling elements are designed to ensure effective heat exchange within the cooling elements. The width of, distances between and diameters of the cooling channels, as well as the materials used, in particular, promote the exchange of thermal energy over as large a surface area as possible.

Furthermore, it is possible for the cooling elements to be fitted via compensators for oscillation damping/oscillation decoupling. The transformer is expediently installed such that the air flows around it at a high speed. Raised installation on open terrain is particularly advantageous, in which case there should be no buildings or obstructions in the prevailing wind direction. The invention is likewise suitable for off-shore substations on the high seas, allowing the cooling installation to be installed freely and at a high level.

Furthermore, the bottom of the platform is designed in such a manner as to achieve vertical air flow on all or parts of the cooling elements, and such that the flow within the cooling elements also makes use of the convection effect. The platform of an on-shore or off-shore substation is designed in such a manner that the supports for a wind turbine are used for the substation and/or for fitting of the cooling installation.

Furthermore, so-called flow guidance devices are provided on the cooling elements in order to channelize the flowing medium onto the cooling elements. One advantageous factor in this case is that the flow speed is increased, and in the ideal case this leads to flow conditions which are always turbulent, and thus to improve heat dissipation. This likewise applies to the deflection of the air flow to the cooling elements and to the production of an additional air flow component. This reduces the influence of the direction of the air flow.

The flow guidance device makes it possible to achieve effective vertical blowing even in the case of a plate-type heat sink or a radiator when the wind direction is transverse with respect to the plate, by deflection of the horizontal air flow. The flow guidance devices result in an improvement of the flow of cooling air around the cooling installation, irrespective of the wind direction. The flow guidance device is in these exemplary embodiments designed so as to achieve an additional air flow without the flow being impeded by parts of the guidance device when the wind direction changes.

BRIEF DESCRIPTION OF THE DRAWINGS

The invention will be explained in more detail with reference to the figure, which is illustrated in the drawing, and in which:

FIG. 2 shows a side view of a transformer according to the invention for an off-shore substation with wind cooling, which figure illustrates a first installation 1.1 producing heat losses (for example, a transformer in a wind park), a second installation 1.2 producing heat losses (for example, a converter), a cooling element 2.2, an oscillation decoupling 2.6 (for example, compensators), a separate attachment 2.7 for the cooling installation, cooling surfaces 3.1, depressions 4.4 in the form of additional cooling surfaces, a platform 8.2 of the offshore substation located above the water level 9.2, and a pier 8.5 of the offshore substation located on the seabed 9.1;

Figure 1:
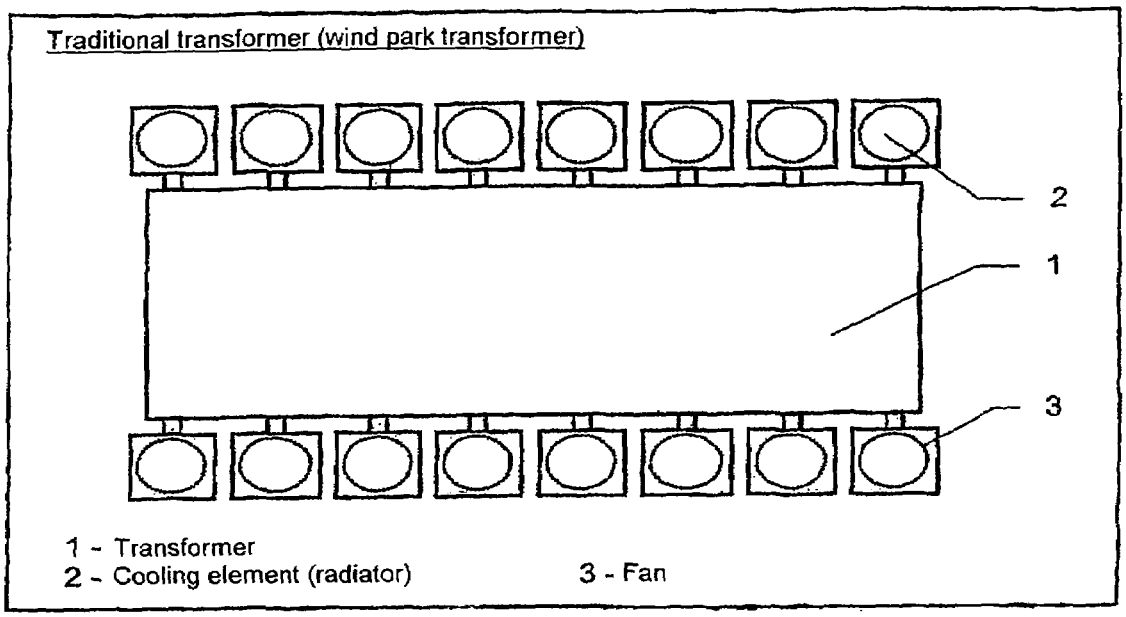
FIG. 1 PRIOR ART
FIG. 1 shows a schematic illustration of a previous transformer with cooling elements arranged in it and including a transformer 1, a cooling element (radiator) 2, and a fan 3.
Figure 3:
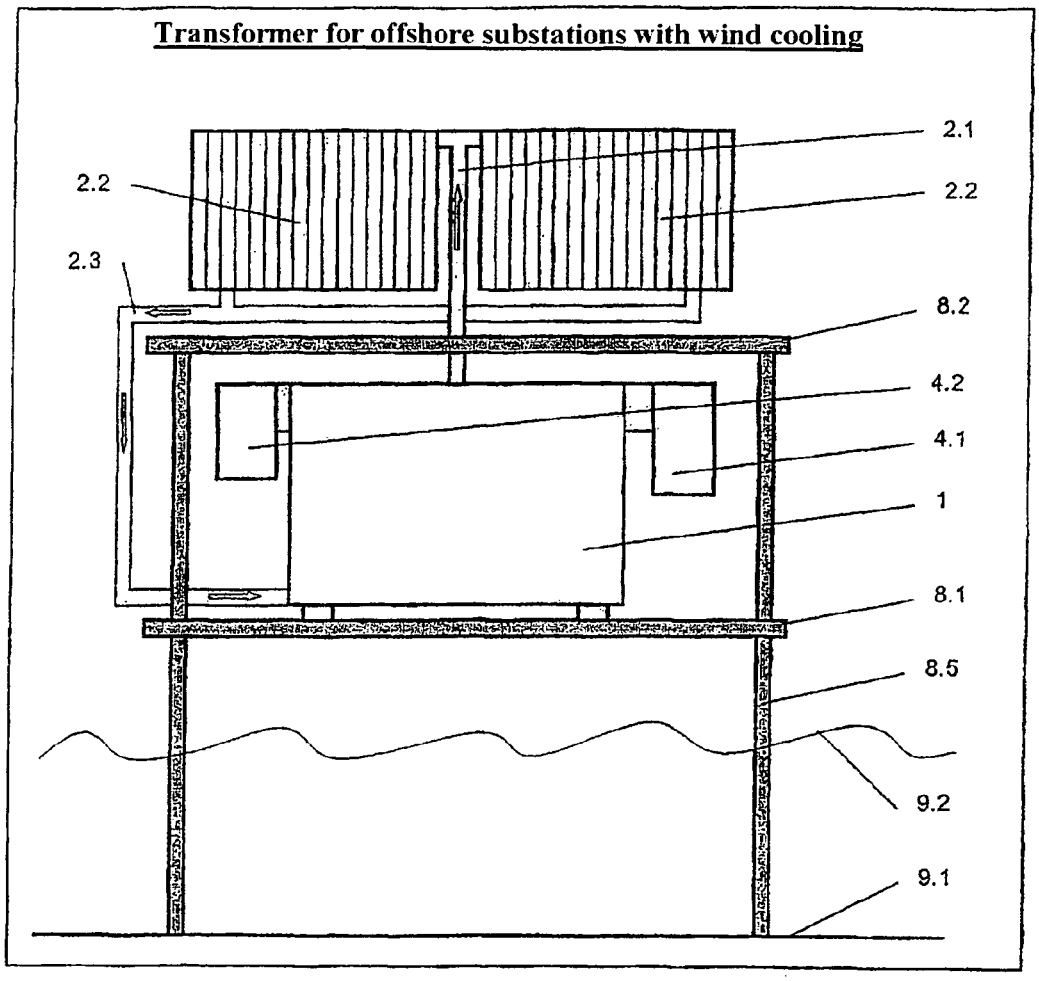
FIG. 3 shows a side view of a transformer 1 according to the invention for an off-shore substation with wind and liquid cooling, and illustrating the transformer 1 located offshore on a platform 8.1.
Figure 4:
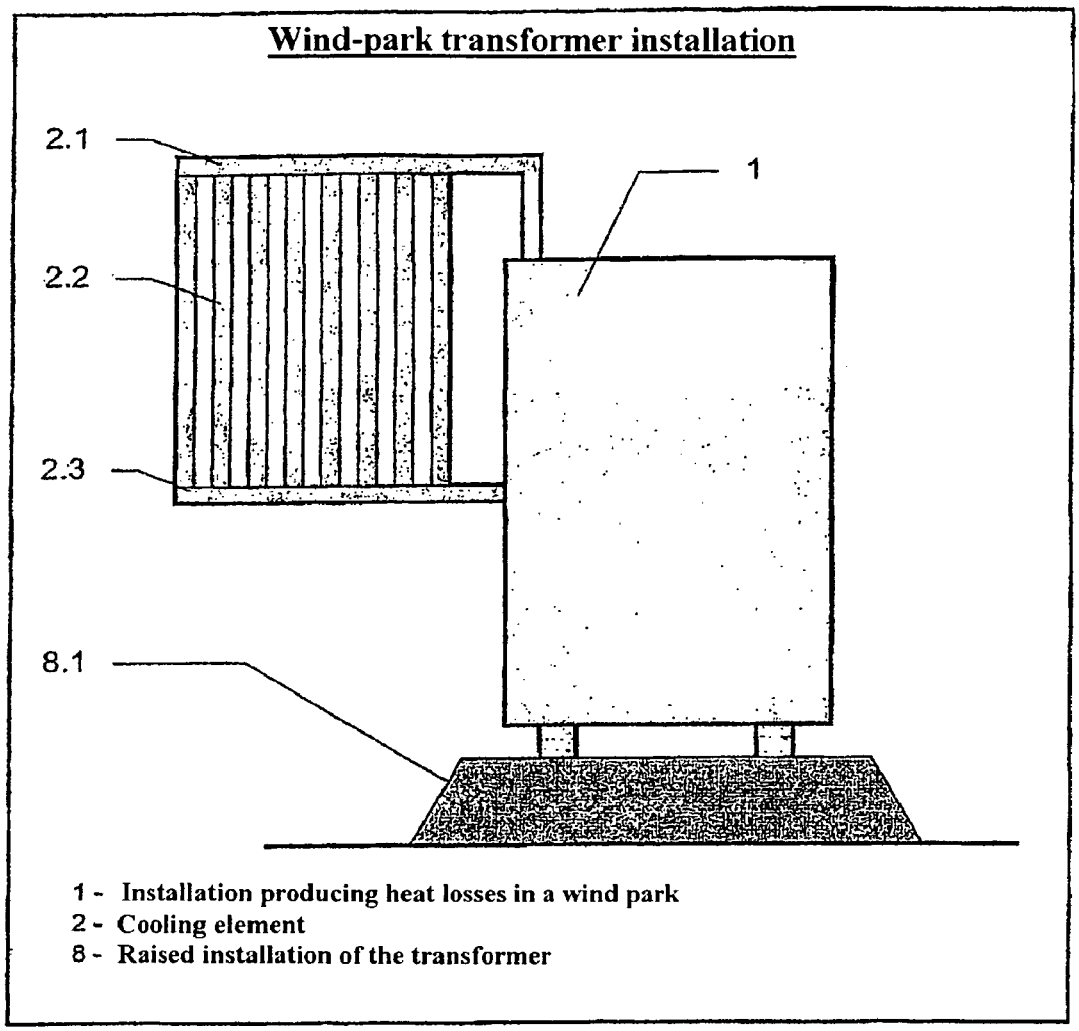
FIG. 4 shows a side view of a transformer according to the invention for a wind park.
Figure 5:
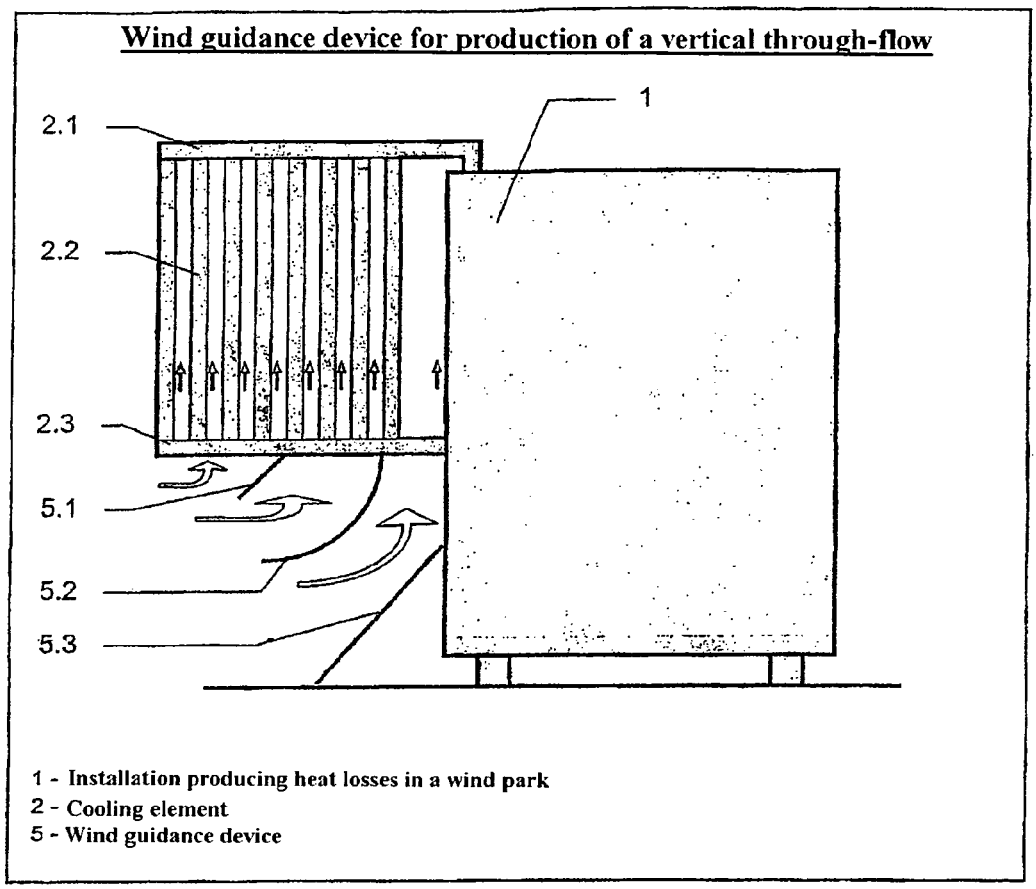
FIG. 5 shows a side view of a transformer according to the invention for a wind park with flow guidance devices.
Figure 6:
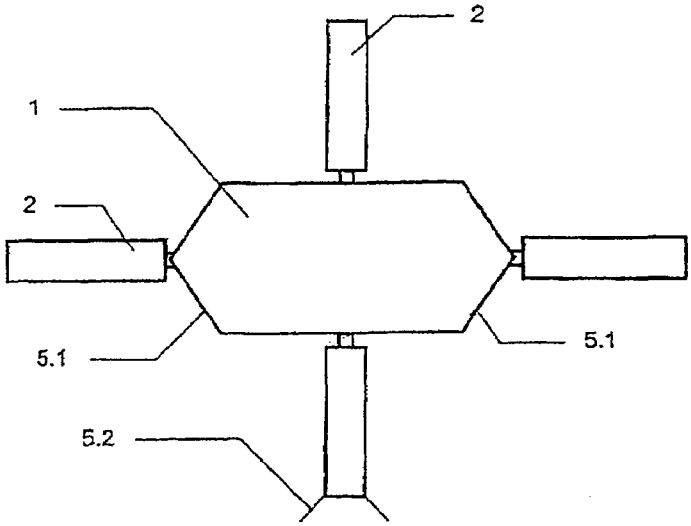
FIG. 6 shows a plan view of a transformer according to the invention with four cooling elements and one flow guidance device, including an air flow guidance device 5.1 formed by a specific design of elements and parts of the outer casing of the transformer, and an air flow guidance device 5.2 for the cooling element.
Figure 7:
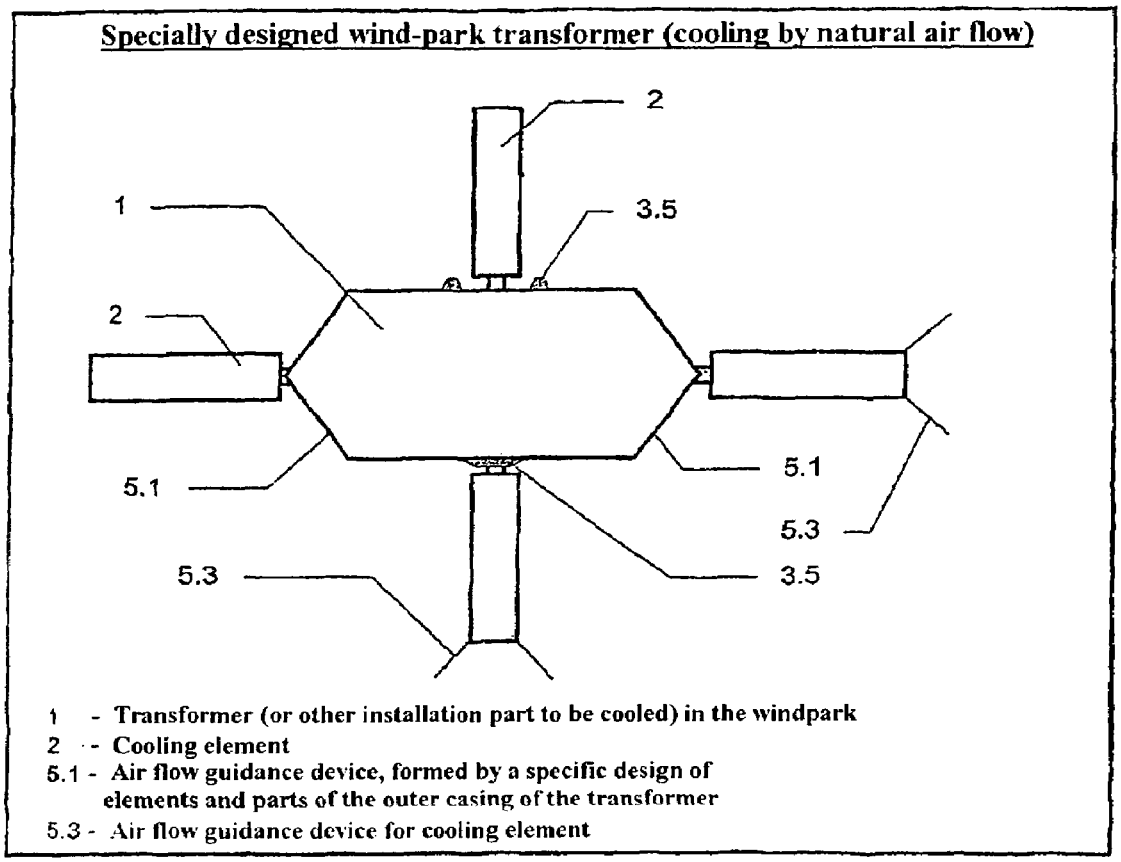
FIG. 7 shows a plan view of a transformer according to the invention with two rigid cooling elements and two cooling elements which configure, as well as two flow guidance devices, including an air flow guidance device 5.1 formed by a specific design of elements and parts of the outer casing of the transformer, and an air flow guidance device 5.3 for the cooling element, and including the pivoting elements 3.5.
Figure 8A:
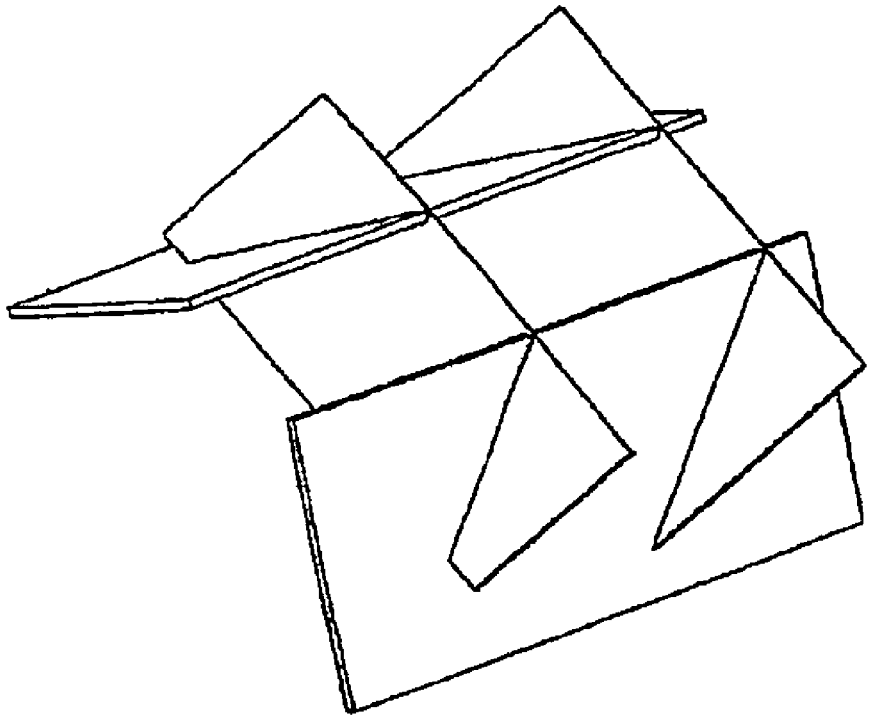
FIGS. 8*a*, 8*b* show a flow guidance device according to the invention.
Figure 8B:
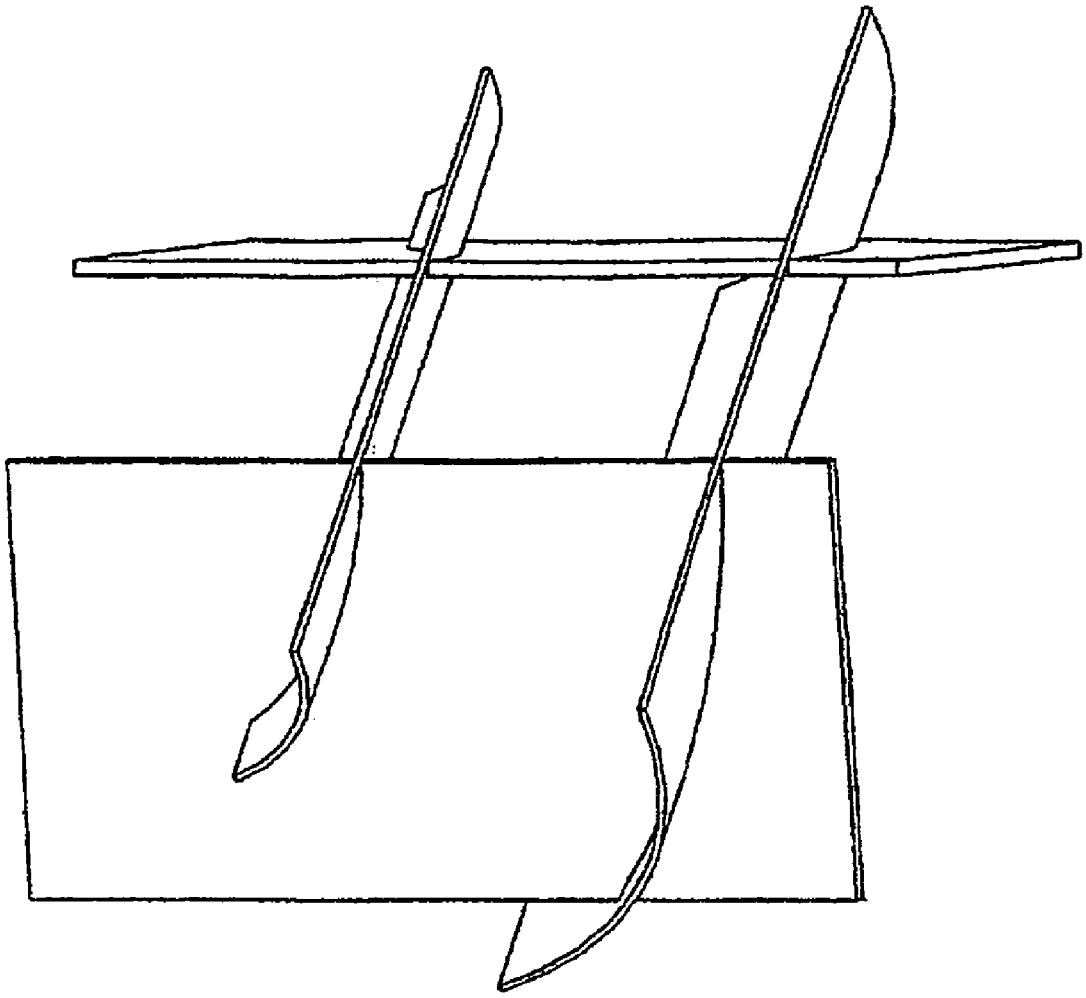
Figure 9:
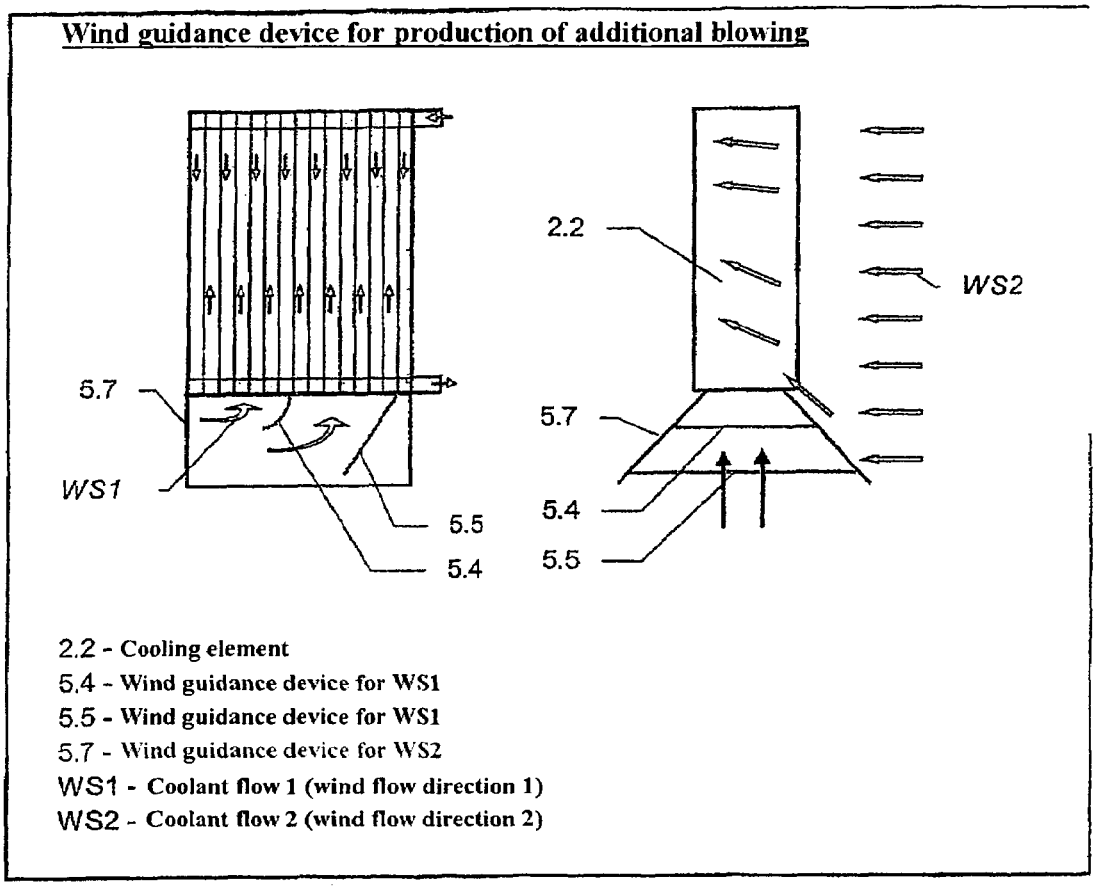
FIG. 9 shows schematic side views of a cooling element with flow guidance devices 5.4, 5.5, 5.7, and a guided cooling medium.
Figure 10:
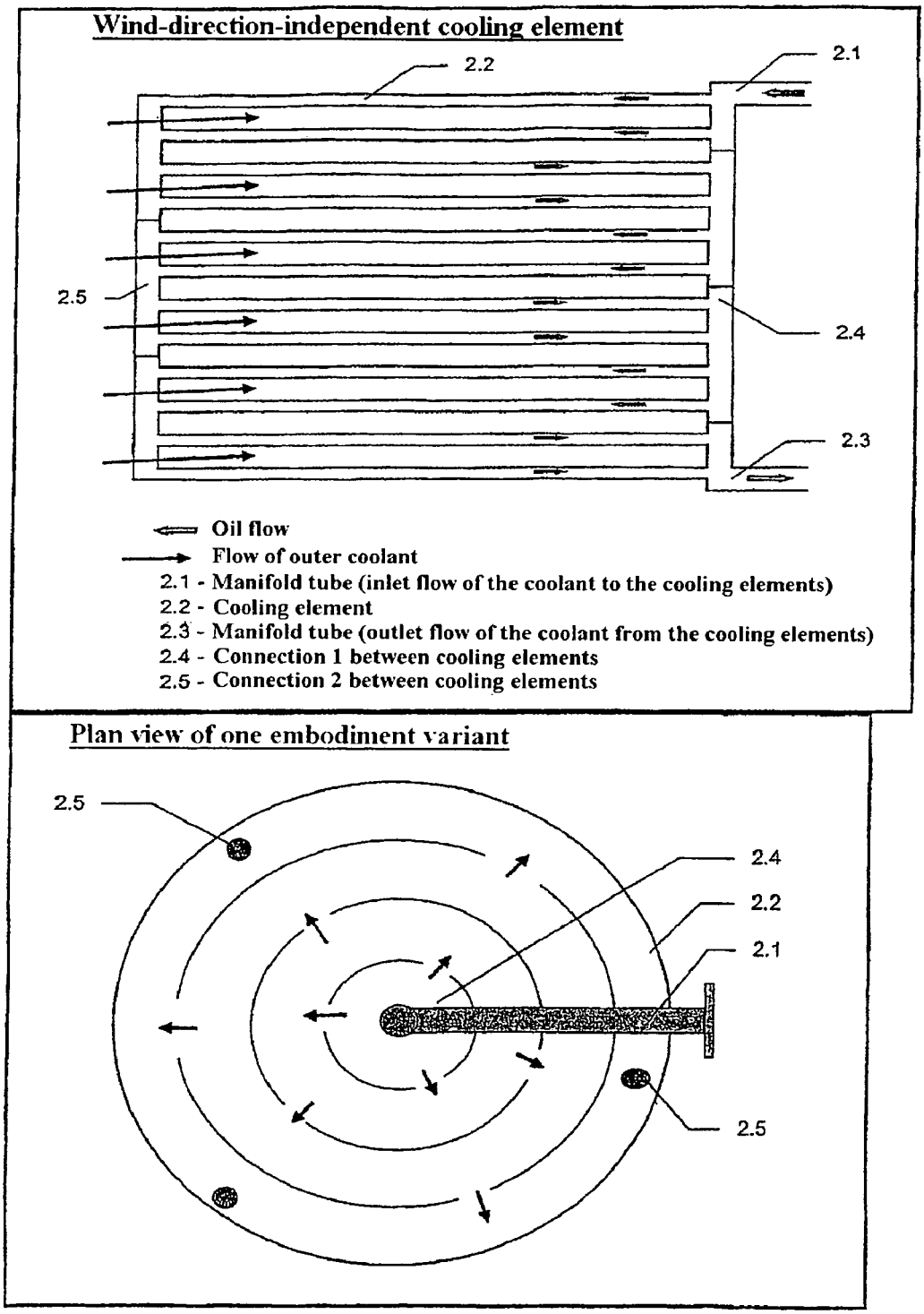
FIG. 10 shows a schematic side view and plan view of a circular cooling element according to the invention, with air and liquid cooling, and illustrating flow through the cooling element, including through the manifold tube 2.1 (inlet flow of the coolant to the cooling elements), the cooling element 2.2, the manifold tube 2.3 (outlet flow of the coolant from the cooling elements), a first connection 2.4 between cooling elements and a second connection 2.5 between cooling elements.
Figure 11:
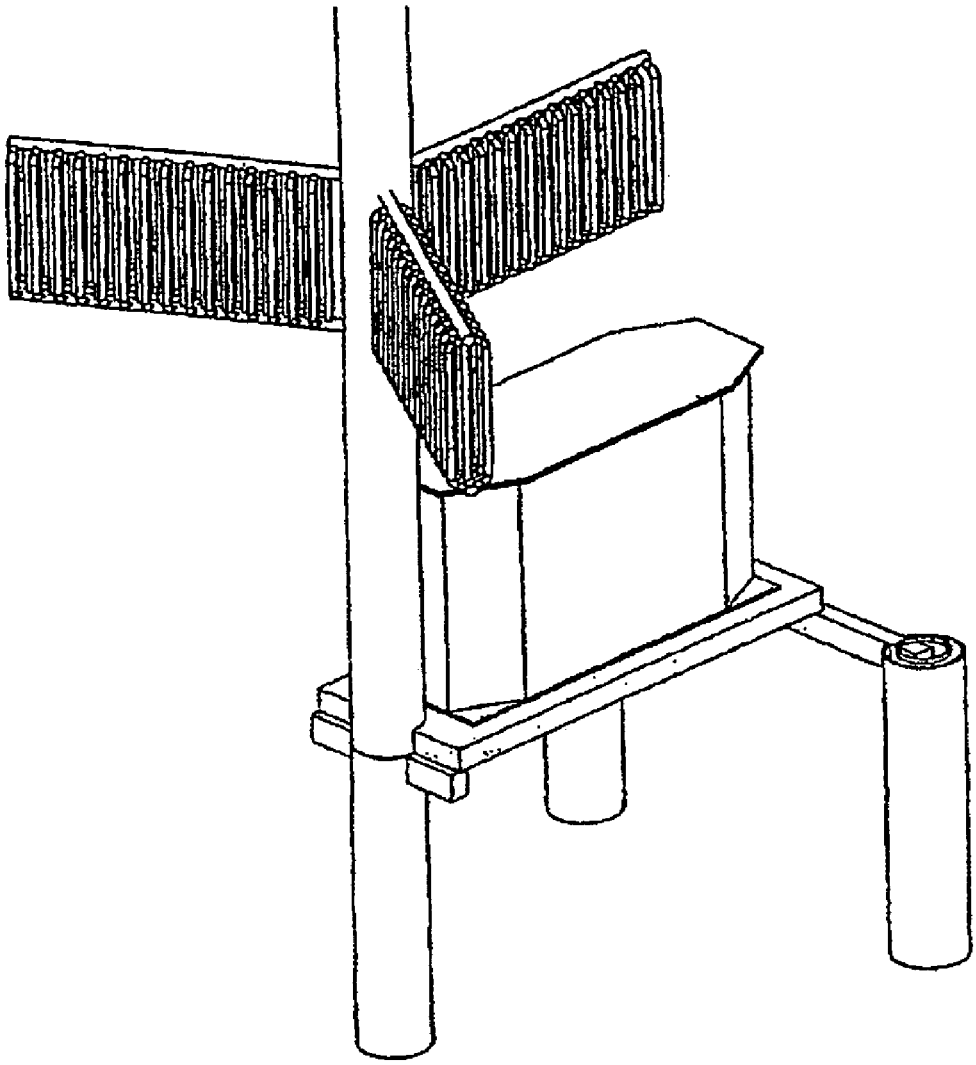
FIG. 11 shows a schematic illustration of a platform according to the invention with cooling elements which are offset in height with respect to the transformer.
Figure 12:
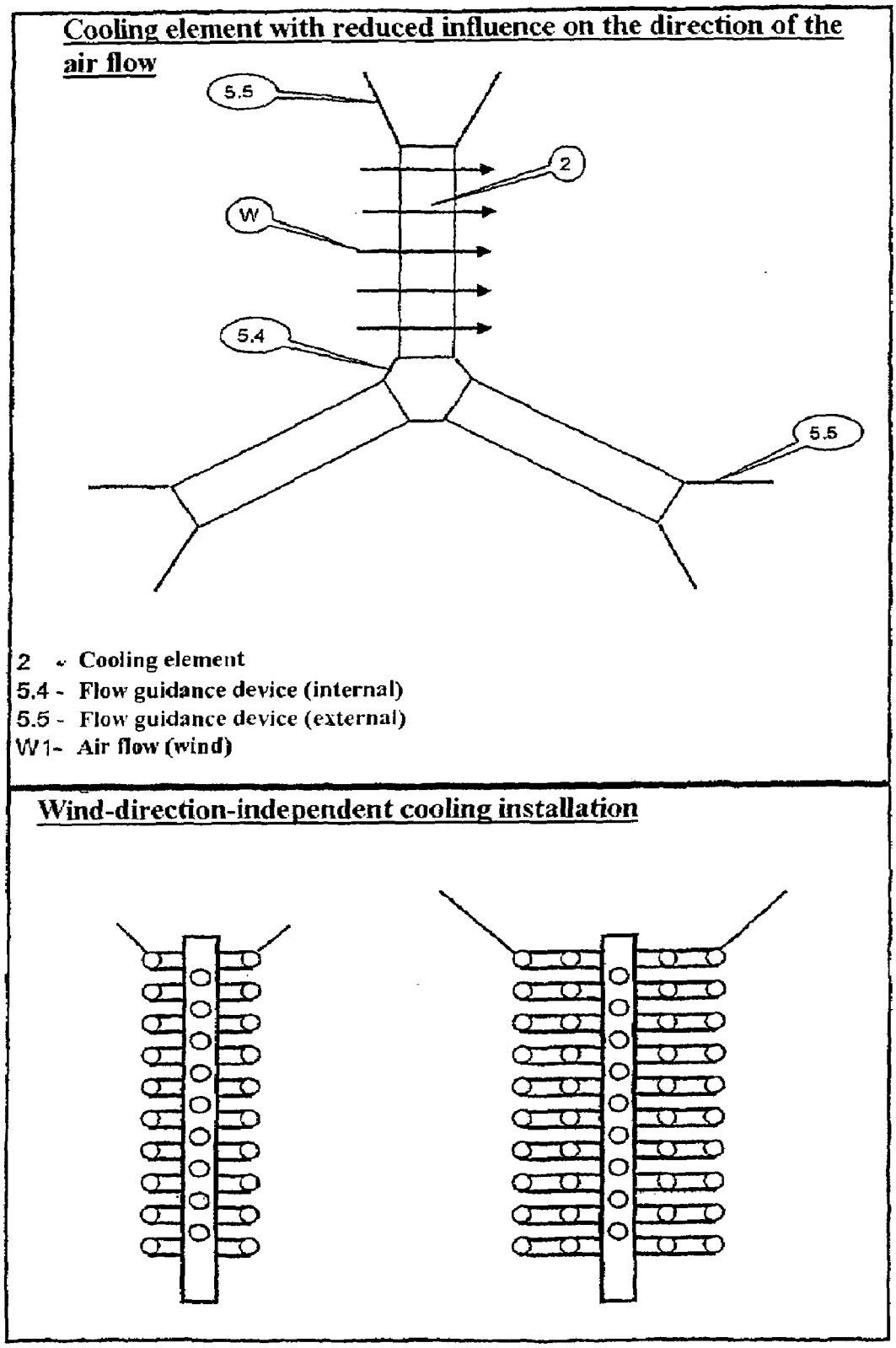
FIG. 12 shows a schematic illustration of a cooling element according to the invention with internally and externally arranged flow guidance devices.

I claim:

1. An electrical installation assembly, comprising:

an electrical installation generating heat during operation, said electrical installation having a hexagonal shape;

cooling elements disposed outside said electrical installation and configured to maximize an area for a medium flowing about said electrical installation.

2. The electrical installation assembly according to claim 1, wherein said electrical installation is a transformer and said cooling elements are maximized for air as the medium flowing around said transformer.

3. The electrical installation assembly according to claim 1, which comprises flow guidance devices configured to focus and to channel the medium flowing around the electrical installation.

4. The electrical installation assembly according to claim 3, wherein said electrical installation is configured to form a flow guidance device for said cooling elements.

5. The electrical installation assembly according to claim 1, wherein said electrical installation comprises a tank, and said cooling elements are configured to avoid radiative emission from the cooling elements virtually at right angles with respect to one another and to ensure that heat is emitted over virtually an entire area of said tank and of said cooling elements.

6. The electrical installation assembly according to claim 1, wherein said electrical installation comprises a tank configured to increase a convection thereof by enlargement of a heat-emitting surface area thereof.

7. The electrical installation assembly according to claim 1, wherein said cooling elements are combined to form a cooling array and/or said cooling elements are installed separately from said electrical installation.

8. The electrical installation assembly according to claim 1, wherein said electrical installation is formed with a surface having a large cross-sectional area in at least two directions.

9. The electrical installation assembly according to claim 1, wherein said cooling elements are pivotally disposed.

10. An electrical installation assembly, comprising:

an electrical installation generating heat during operation;

cooling elements pivotally disposed outside said electrical installation and configured to maximize an area for a medium flowing about said electrical installation.

11. The electrical installation assembly according to claim 10, wherein said electrical installation is a transformer and said cooling elements are maximized for air as the medium flowing around said transformer.

12. The electrical installation assembly according to claim 10, which comprises flow guidance devices configured to focus and to channel the medium flowing around the electrical installation.

13. The electrical installation assembly according to claim 12, wherein said electrical installation is configured to form a flow guidance device for said cooling elements.

14. The electrical installation assembly according to claim 10, wherein said electrical installation comprises a tank, and said cooling elements are configured to avoid radiative emission from the cooling elements virtually at right angles with respect to one another and to ensure that heat is emitted over virtually an entire area of said tank and of said cooling elements.

15. The electrical installation assembly according to claim 10, wherein said electrical installation comprises a tank configured to increase a convection thereof by enlargement of a heat-emitting surface area thereof.

16. The electrical installation assembly according to claim 10, wherein said cooling elements are combined to form a cooling array and/or said cooling elements are installed separately from said electrical installation.

17. The electrical installation assembly according to claim 10, wherein said electrical installation is formed with a surface having a large cross-sectional area in at least two directions.

* * * * *